United States Patent [19]

Matthews et al.

[11] 4,206,358

[45] Jun. 3, 1980

[54] TECHNETIUM-99 GENERATORS

[75] Inventors: Ralph W. Matthews, Georges Hall; Rex E. Boyd, Engadine, both of Australia

[73] Assignee: Australian Atomic Energy Commission, Coogee, Australia

[21] Appl. No.: 951,942

[22] Filed: Oct. 16, 1978

[30] Foreign Application Priority Data

Oct. 19, 1977 [AU] Australia ..... PD2113

[51] Int. Cl.[2] ..... G21G 4/08

[52] U.S. Cl. ..... 250/432 PD; 252/301.1 R; 252/462; 252/463; 422/159

[58] Field of Search ..... 250/432 PD; 252/301.1 R, 462, 463; 422/159

[56] References Cited

U.S. PATENT DOCUMENTS

| | | | |
|---|---|---|---|
| 3,468,808 | 9/1969 | Arino | 252/301.1 R |
| 3,785,990 | 1/1974 | Benjamins et al. | 250/432 PD |
| 3,827,986 | 8/1974 | Charlton et al. | 252/301.1 R |
| 3,833,509 | 9/1974 | Brown et al. | 252/301.1 R |
| 3,907,583 | 7/1976 | Panek-Finda | 252/301.1 R |
| 4,062,810 | 12/1977 | Vogt et al. | 252/462 |

*Primary Examiner*—Benjamin R. Padgett
*Assistant Examiner*—Deborah L. Kyle
*Attorney, Agent, or Firm*—Ladas, Parry, Von Gehr, Goldsmith & Deschamps

[57] ABSTRACT

A generator for liquid containing $^{99m}$Tc has an adsorbant bed of alumina, zirconia or the like and has associated therewith a quantity of an electron scavenging compound of a rare earth, silver or gold so as to maintain elution efficiency during the working life of the generator. The compound may be a rare earth oxide such as ceric oxide typically present as a coating on alumina particles in an amount of about 0.1% by weight or a compound such as silver chloride present in quantities typically of about 5%. The eluant may be sodium or potassium perchlorate in water.

9 Claims, 2 Drawing Figures

TECHNETIUM-99 GENERATORS

FIELD OF THE INVENTION

This invention relates to an isotope generator for the production of liquids containing $^{99m}$Tc (technetium-99m) which is produced by the radioactive decay of $^{99}$Mo (molybdenum-99).

BACKGROUND OF THE INVENTION

The radioisotope $^{99m}$Tc is suitable for medical diagnostic purposes on account of its low toxicity, emission of suitable $\gamma$-radiation and a short half-life. In certain applications a direct injection into a patient of a solution containing the isotope may be used or $^{99m}$Tc may be used to label other substances.

SUMMARY OF PRIOR ART

A conventional technetium generator has a reservoir provided with inlet and outlet openings and containing an adsorbant for the $^{99}$Mo. During use of the generator, usually at 24 hour intervals, a washing liquid or eluant is admitted via the inlet opening at the top of the generator to pass through the adsorbant removing the $^{99m}$Tc present. The eluate containing the $^{99m}$Tc leaves the generator at the bottom via the outlet opening. This "milking process" is usually conducted with normal saline solution, although less concentrated salt solutions could be used.

The choice of the adsorbant, the chemical forms of $^{99}$Mo and $^{99m}$Tc, and the washing liquid must be such that during elution a high proportion of the available $^{99m}$Tc is removed from the adsorbant and, due to its toxicity, all or almost all of the $^{99}$Mo is retained on the adsorbant. In a $^{99m}$Tc generator alumina ($Al_2O_3$) is frequently used as the adsorbant, and, the $^{99}$Mo is applied as a soluble molybdate, the $^{99m}$Tc produced by the radioactive decay of the $^{99}$Mo having the chemical form pertechnetate.

The $^{99m}$Tc generators supplied to hospitals commonly have around 500 millicuries of $^{99}$Mo activity at the start of their first milking. It is well known that in such conventional generators a marked decrease in milking efficiency (the percentage of $^{99m}$Tc actually recovered of the $^{99m}$Tc theoretically available) occurs within several days after the preparation of the generator. It has been found that the addition of certain solutes to the eluant helps to prevent this decrease in milking efficiency. Solutes found to be useful in this respect are dichromate and nitrate ions as well as a number of other species which have oxidizing properties.

The generator is normally allowed to remain full of eluant between milkings. The radiation dose received by the eluant in contact with the adsorbant during milkings is quite significant when the generator has been initially loaded with a typical activity of the order of 500 millicuries or greater. It is known that highly reactive free radical radiolytic species, including hydrated electrons, are formed in the eluant under these conditions and that these species may frequently initiate a complex series of chemical reactions. One of the reactions believed to occur in technetium generators is the reduction of pertechnetate ions to a form which is not readily eluted from the adsorbant. Another theory is that the molybdate ions may be reduced to a form which yields $^{99m}$Tc in a lower valency state, which again is not readily eluted from the adsorbant. This hypothesis is supported by the behavior of the previously mentioned solutes, dichromate and nitrate ions, which help prevent loss of elution efficiency and which are known to be scavengers for hydrated electrons, i.e. they react rapidly with hydrated electrons thereby inhibiting the reaction of hydrated electrons with other species such as molybdate and pertechnetate.

Although dichromate is an excellent scavenger for hydrated electrons, and also is a known oxidizing agent, one disadvantage associated with the use of dichromate is its physiological toxicity and therefore the concentration at which it may be used is limited.

The use of nitrate ion in the eluant for technetium generators is the subject of Australian patent specification No. 464043.

In U.S. Pat. No. 3,970,583 it is claimed that excellent elution efficiencies from a technetium generator are obtained with normal saline eluant if the adsorbant alumina contains fully or partly hydrated manganese dioxide, thereby obviating the pretreatment of the alumina with nitric acid, a technique described in U.S. Pat. No. 3,785,990.

OBJECTIVES OF THE INVENTION

It would, however, be desirable to produce new and useful alternatives to known technetium generators with a view to providing consistently high elution efficiencies during the normal working life of a generator with the highest possible radionuclidic purity of the eluate, the generator furthermore being capable of manufacture in a convenient and safe form which can readily be operated with preferably only simple steps by semi-skilled laboratory technicians.

SUMMARY OF THE INVENTION

The present invention is directed to a new generator characterized by including in the adsorbant column an electron scavenging compound from a selected group of compounds.

The adbsorbant column is of a metal oxide such as alumina having a relatively high affinity to a molybdenum-99 compound (such as molybdate) and a relatively low affinity to the technetium-99m daughter product. The adsorbant includes the electron scavenging associated compound which is a compound of a rare earth, silver or gold, which is retained with the adsorbant sufficiently strongly so as to avoid any major removal of the associated compound during milking. The associated compound has the purpose of at least reducing what would otherwise be a loss of elution efficiency during the working life of the generator due to complex reactions which are not fully understood.

An important range of embodiments of the invention comprises the use, as the associated compound, of a four-valent oxide of a rare earth of which the following group is the most important:

Cerium, praseodumium, neodymium and terbium.

Alternatively, advantageous embodiments of the invention make use of electron scavenging compounds of silver or gold such a silver chloride or gold chloride.

The associated compound may be in the form of a coating for particles of the metal oxide adsorbant although this is not essential.

Another advantageous feature which may be included is the milking of the generator by the use of an aqueous solution of sodium perchlorate or potassium perchlorate instead of the conventional normal saline solution.

To obtain the most beneficial results, the quantity of associated compound is carefully controlled since in general optimum values do exist. In the case of ceric oxide it has been found that a preferred amount of about 0.1% by weight of the adsorbant is very beneficial.

Where silver chloride is the associated compound, it has been found that about 5% by weight of the adsorbant is preferred.

EXAMPLES OF THE INVENTION

EXAMPLE 1

A generator was formed with the adsorbant being alumina and the associated compound ceric oxide. The details of the generator and its performance were as follows:

Adsorbant: 0.1% $CeO_2$ by weight on 2 g $Al_2O_3$.
Activity: 1115 mCi $^{99}Mo$ as sodium molybdate
Elution Liquid: Normal Saline Solution ELUTION EFFICIENCY AND RADIONUCLIDIC PURITY
(All As Percentages)

| Days After Loading | Elution Efficiency | $^{99m}Tc$ | $^{99}Mo$ | $^{132}I$ |
|---|---|---|---|---|
| 3 | 100 | 99.9929 | <0.0007 | 0.0071 |
| 4 | 99.4 | 99.9888 | 0.0005 | 0.0106 |
| 5 | 98.9 | 99.9903 | <0.0008 | 0.0097 |
| 6 | 96.4 | 99.9843 | <0.0011 | 0.0157 |
| 7 | 92.9 | 99.9742 | <0.0013 | 0.0257 |

It was unnecessary to include either dichromate or nitrate ions in the normal saline eluant in order to maintain high technetium elution efficiencies from the generator. Not only were efficiencies of greater than 90% obtained throughout a seven day period, but there was found a significantly better radionuclidic purity than that usually obtained from a technetium generator using uncoated $Al_2O_3$.

The alumina was coated with ceric oxide by adding a dilute nitric acid solution of ceric ammonium nitrate to sufficient alumina to give approximately 0.1% by weight as $CeO_2$ on $Al_2O_3$. The treated alumina suspension was separated and dried under reduced pressure in a rotary evaporator. It was then heated at 550° C. for several hours in the presence of air. After cooling it was sieved and the 53–124 micron particle size retained for use in the technetium generator.

EXAMPLE 2

Absorbant material for a technetium generator was formed incorporating ceric oxide particles in the alumina for the column. Ceric oxide was co-precipitated along with aluminium hydroxide and the co-precipitate then processed conventionally to form the particulate column for the generator.

EXAMPLE 3

A technetium generator was formed in a similar manner to that of Example 1 and was operated using sodium perchlorate as the eluant in place of the normal saline solution. The details of the generator are as follows:

Adsorbant: 0.1% $CeO_2$ by weight on $Al_2O_3$
Activity: 1055 mCi $^{99}Mo$ as sodium molybdate
Elution Liquid: 0.15 M $NaClO_4$ ELUTION EFFICIENCY AND RADIONUCLICID PURITY
(All As Percentages)

| Days After Loading | Elution Efficiency | $^{99m}Tc$ | $^{99}Mo$ | $^{132}I$ |
|---|---|---|---|---|
| 3 | 100 | 99.995 | 0.0024 | 0.0025 |
| 4 | 99.0 | 99.998 | <0.0012 | 0.0018 |
| 5 | 97.2 | 99.998 | <0.0004 | 0.0016 |
| 6 | 99.1 | 99.995 | <0.0011 | 0.0054 |
| 7 | 96.6 | 99.9976 | <0.0006 | 0.0024 |

Again compared with conventional generators, a high radionuclidic purity in the eluate was found.

EXAMPLE 4

In this example an adsorbant bed of aluminium bed of aluminium oxide has associated therewith a quantity of silver chloride and high efficiencies have been found. The details of the generator are given in the following table.

Adsorbant: 0.5% AgCl on $Al_2O_3$
Activity: 930 mCi $^{99}Mo$ as molybdic acid
Elution Liquid: Normal Saline Solution ELUTION EFFICIENCY AND RADIONUCLIDIC PURITY
(All As Percentages)

| Days After Loading | Elution Efficiency | $^{99m}Tc$ | $^{99}Mo$ | $^{132}I$ |
|---|---|---|---|---|
| 4 | 100 | 99.99 | 0.0004 | 0.0023 |
| 5 | 96.1 | 99.994 | 0.0011 | 0.0049 |
| 6 | 92.4 | 99.995 | 0.0004 | 0.0043 |
| 7 | 84.6 | 99.996 | 0.0005 | 0.0038 |
| 7 | 95.7 | — | — | — |

This generator was formed by preparing the adsorbant bed by adding a dilute solution of silver nitrate in approximately 0.1 molar nitric acid to alumina thereby yielding a suspension of alumina including about 0.5% by weight silver nitrate. This suspension was dried under reduced pressure in a rotary evaporator and then heated to 220° C. for several hours in the presence of air. After cooling the treated alumina was seived and a particle size fraction in the range 53–124 microns was retained for use in the technetium generator. The silver nitrate was transformed into silver chloride by washing with saline solution, since the chloride ions of the saline solution rapidly transform the silver nitrate into the highly insoluble silver chloride which is strongly bound into the adsorbant bed.

The chloride ions may be introduced by the passage of normal saline solution before the generator is passed into service, the liberated nitrate ions then being removed by washing.

Throughout a seven day working period, which is normal for technetium generators, a high efficiency was obtained greater than 80% and significantly better radionuclidic purity was obtained compared with conventional technetium generators.

EXAMPLE 5

A generator was formed in a similar manner to that of Example 4 but loaded with 2185 millicuries of molybdenum-99. To overcome a markedly decreased elution efficiency on about the sixth day which occurred in certain experiments with this generator of high activity, a much greater quantity of silver chloride, namely 2.5% by weight of alumina was included. It was thought that in the unsuccessful experiments, complete reduction of the silver chloride to silver metal had occurred by the sixth day and therefore to achieve high efficiency throughout the working life of the generator, larger quantities of silver chloride are needed in higher activity generators.

Details of the generator were as follows:
Adsorbant: 2.5% AgCl on $Al_2O_3$
Activity: 2240 mCi $^{99}Mo$ molybdic acid
Elution Liquid: Normal Saline Solution.

ELUTION EFFICIENCY AND RADIONUCLIDIC PURITY
(All As Percentages)

| Days After Loading | Elution Efficiency | $99m_{Tc}$ | $99_{Mo}$ | $132_I$ |
|---|---|---|---|---|
| 2 | 100 | 99.99905 | 0.00043 | 0.00051 |
| 4 | 100 | 99.99866 | 0.00019 | 0.00114 |
| 5 | 99.6 | 99.99820 | 0.00039 | 0.00140 |
| 6 | 99.2 | 99.99821 | 0.00030 | 0.00149 |
| 7 | 91.6 | 99.99826 | 0.00034 | 0.00142 |

EXAMPLE 6

A generator was formed in a manner similar to that of Example 5 except that in this case the alumina coated with silver nitrate was treated before location in the generator, the treatment comprising washing with saline solution to convert the silver nitrate to silver chloride, filtering off of the treated alumina and drying at 225° C. for 24 hours. The treated alumina was packed in the generator and the generator subsequently placed into service. The details and performance of the generator are given below:
Adsorbant: 2.5% AgCl on $Al_2O_3$
Activity: 2455 mCi $^{99}Mo$
Elution Liquid: Normal Saline Solution ELUTION EFFICIENCY AND RADIONUCLIDIC PURITY
(All As Percentages)

| Days After Loading | Elution Efficiency | $99m_{Tc}$ | $99_{Mo}$ | $132_I$ |
|---|---|---|---|---|
| 3 | 100 | 99.9967 | 0.0026 | 0.0008 |
| 4 | 98.9 | 99.9963 | 0.0027 | 0.0009 |
| 5 | 98.0 | 99.9962 | 0.0026 | 0.0012 |
| 6 | 97.1 | 99.9959 | 0.0031 | 0.0010 |
| 7 | 93.2 | 99.9947 | 0.0033 | 0.0020 |

EXAMPLE 7

A generator was formed similarly to the arrangement of Example 6 except that in this case the treated alumina having the silver chloride coating was heated at 300° C. for 24 hours. The eluates were analysed for radionuclidic purity and in this case the analysis for silver was conducted by atomic absorption spectroscopy. The details of the generator and its performance were as follows:
Adsorbant: 2.5% AgCl on $Al_2O_3$
Activity: 2210 mCi $^{99}Mo$
Elution Liquid: Normal Saline Solution ELUTION EFFICIENCY AND RADIONUCLIDIC PURITY
(All As Percentages Except Last Column)

| Days After Loading | Elution Efficiency | $99m_{Tc}$ | $99_{Mo}$ | $132_I$ | Ag (mg/l) |
|---|---|---|---|---|---|
| 3 | 100 | 99.9987 | 0.00030 | 0.0010 | 0.5 |

-continued

ELUTION EFFICIENCY AND RADIONUCLIDIC PURITY
(All As Percentages Except Last Column)

| Days After Loading | Elution Efficiency | $99m_{Tc}$ | $99_{Mo}$ | $132_I$ | Ag (mg/l) |
|---|---|---|---|---|---|
| 4 | 100 | 99.9988 | 0.00023 | 0.0010 | 0.55 |
| 5 | 100 | 99.9988 | 0.00027 | 0.0010 | 0.45 |
| 6 | 100 | 99.9987 | 0.00036 | 0.0010 | 0.4 |

EXAMPLE 8

A generator of conventional form was manufactured using aluminium oxide as the adsorbant. Before placing the generator into service, the adsorbant alumina was washed with a 1% solution of silver nitrate in a 1 M nitric acid solution.

Prior to the first elution, normal saline solution was used to wash the generator thereby converting the silver nitrate asociated with the adsorbant bed to silver chloride and after washing the generator could be put into service.

The details of the generator and performance are summarized below:
Adsorbant: Ordinary $Al_2O_3$ washed with 1% $AgNO_3$ in 1 M HN in the generator bottle
Activity: 2160 mCo $^{99}Mo$
Elution Liquid: Normal Saline Solution ELUTION EFFICIENCY AND RADIONUCLIDIC PURITY
(All As Percentages)

| Days After Loading | Elution Efficiency | $99m_{Tc}$ | $99_{Mo}$ | $132_I$ |
|---|---|---|---|---|
| 3 | 100 | 99.9986 | 0.00058 | 0.00078 |
| 4 | 100 | 99.9982 | 0.00068 | 0.0012 |
| 5 | 100 | 99.9981 | 0.00067 | 0.0013 |
| 6 | 100 | 99.9978 | 0.00066 | 0.0015 |
| 7 | 95.4 | 99.9973 | 0.00135 | 0.0014 |

FORM OF GENERATOR

The form of the generator can be basically conventional but preferably in accordance with a further inventive feature, the generator may be formed from a reservoir of tough heat resistant glass such as that sold under the trade mark PYREX. In a preferred embodiment the reservoir is an open-ended cylindrical body having an upper opening sealed by a piercable cap. The adsorbant is located inside the reservoir between a lower sintered glass disc integrally fused to the body of the reservoir, and an upper gauze disc held in place by a ring. Tubes having hollow injection needles are used to introduce eluant and pass eluate into a collection vessel.

Upon delivery to the user, the generator already has radioactive molybdenum-99 adsorbed on the alumina so that the user can extract liquid containing technetium-99 from the generator by means of an elution process at any desired time.

The generator is loaded with radioactive molybdate solution in the following way. Firstly, 2 g of the adsorbant are placed in the generator reservoir and washed with about 5 ml of 1 M nitric acid. The required activity of $^{99}Mo$ was then added in the form of sodium molybdate-99 solution of approximate specific activity 0.018 curie per microgram. The generator is allowed to stand for one hour and the pierceable cap applied. Before use, the adsorbant is washed with 200 ml water followed by 60 ml of normal saline solution, the washing liquids being added under pressure through a hollow injection needle inserted through the rubber cap.

BRIEF DESCRIPTION OF THE DRAWINGS

A preferred embodiment of this form of generator will now be described for illustrative purposes only with reference to the accompanying drawings, of which.

DETAILED DESCRIPTION OF THE ILLUSTRATED GENERATOR

Figure 1:
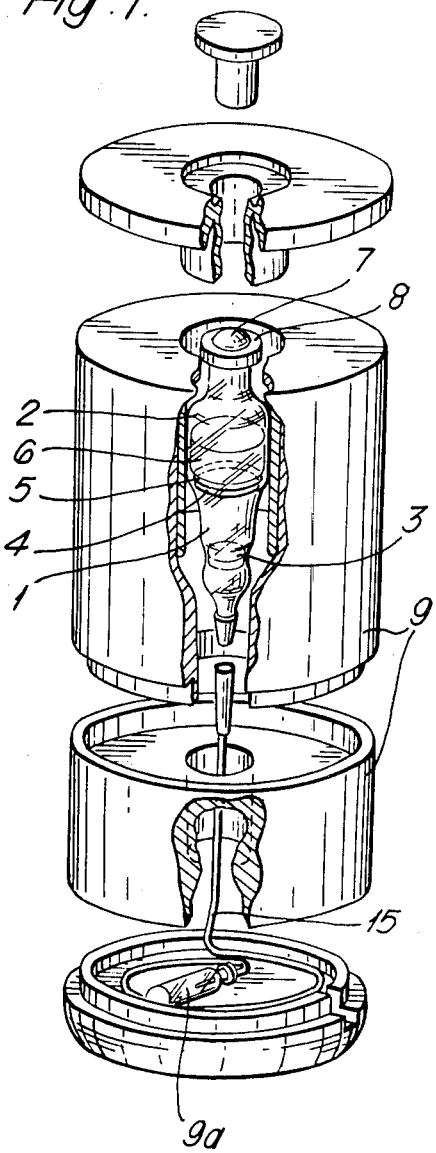
FIG. 1 is an exploded view of a generator embodying the invention.

Referring first to FIG. 1, the generator comprises an adsorbant bed 1 located inside a glass reservoir 2 which is mounted within a main section of a lead shielding cylinder 9, foam rubber packing surrounding the glass reservoir to protect it against vibration. The adsorbant bed 1 is supported on a glass frit filter 3 and to secure to bed in place, on top of the bed there is provided a glass wool disc 4, a terylene gauze disc 5, and a polythene retaining ring 6. The generator is sealed at the top with a rubber serum cap 7 and metal ring 8, and at the bottom a delivery table 15 leads to a bottle 9*a* containing bactericidal agent. The bottle 9*a* is discarded when the generator is set up for milking.

The lead cylinder 9 is formed in several sections which interengage and are secured together by strong adhesive tape omitted from the drawing for the purpose of clarity.

Figure 2:
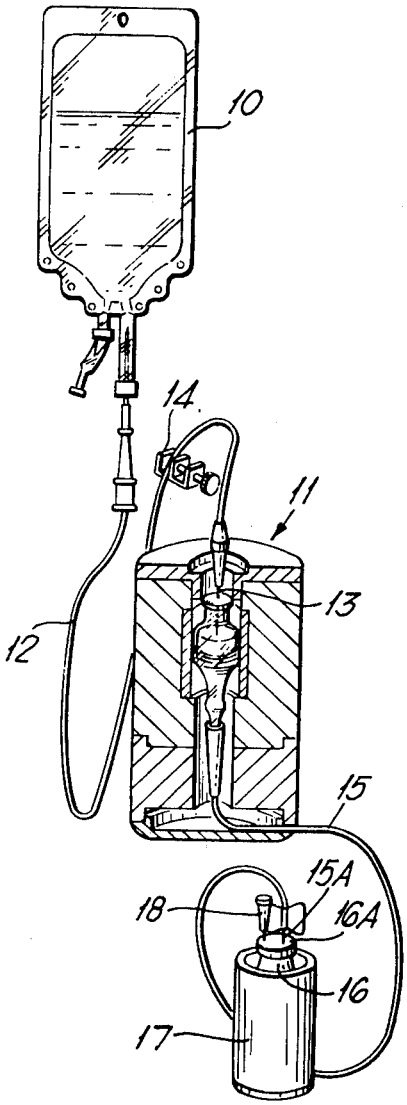
FIG. 2 is a schematic view illustrating milking the generator of FIG. 1.

Referring to FIG. 2, when $^{99m}$Tc is required from the generator, elution liquid (eluant) from a bag 10 is admitted to the generator 11 via a drip tube 12 and hollow injection needle 13 by releasing a pinch clip 14. The eluant passes through the adsorbant under gravity, removing the $^{99m}$Tc. The resultant eluate passes through delivery tube 15 and connecting needle 15*a* into a collection bottle 16 having its associated shielding bottle 17 of lead. A vent needle 18 vents the bottle 16 to atmosphere.

The flow of liquid through the generator 11 is stopped by closing the pinch clip 14. The connecting needle 15*a* and vent needle 18 are then withdrawn from the collection bottle and the radioactive eluate may be sterilized by autoclaving. The $^{99m}$Tc so prepared may be used in direct injections for certain applications or used to prepare radiopharmaceuticals labelled with $^{99m}$Tc.

We claim:

1. In an isotope generator for the production of liquids containing $^{99m}$Tc comprising:
   (a) a container having a liquid inlet and a liquid outlet to permit the generator to be milked by the passage of a liquid eluant,
   (b) a quantity of adsorbant located in the container,
   (c) the adsorbant being a metal oxide having a relatively high affinity to a molybdenum-99 compound and a relatively low affinity to the technetium-99m daughter product of the molybdenum-99 compound, the improvement comprising:
   (d) an associated compound bound into the adsorbant and resistant to elution with said daughter product, said associated compound being an electron scavenging compound selected from the group consisting of compounds of rare earth, silver and gold.

2. An isotope generator according to claim 1, wherein said associated compound is a rare earth oxide with the rare earth in the four-valent form and selected from the group consisting of cerium, praseodymium, neodymium and terbium.

3. An isotope generator as claimed in claim 2, wherein said associated compound comprises ceric oxide present in a quantity in the range of 0.25% to 0.5% by weight of the adsorbant.

4. An isotope generator as claimed in claim 3, wherein said ceric oxide is present in an amount approximately 0.1% by weight of the adsorbant.

5. An isotope generator as claimed in claim 1, wherein said associated compound is selected from the group consisting of silver chloride and gold chloride.

6. As isotope generator as claimed in claim 5, wherein the associated compound is present in a quantity of approximately 5% by weight of the adsorbant.

7. An isotope generator as claimed in claim 1, wherein said adsorbant comprises particles of alumina and said associated compound is present as a coating on said alumina particles.

8. In an isotope generator for the production of liquids containing $^{99m}$Tc comprising an associated compound included with the adsorbant, the associated compound being a four-valent rare earth oxide of a rare earth selected from the group consisting of cerium, praseodymium, neodymium and terbium, said rare earth oxide being present in a quantity of approximately 0.1% by weight of adsorbant.

9. An isotope generator as claimed in claim 1 and further comprising a supply of aqueous eluant selected from the group consisting of sodium perchlorate and potassium perchlorate.

* * * * *